US005205304A

United States Patent [19]

Cooper et al.

[11] Patent Number: 5,205,304

[45] Date of Patent: Apr. 27, 1993

[54] RINSE AID DISPENSER

[75] Inventors: Randall L. Cooper; Thomas M. Johnson, both of Newton, Iowa

[73] Assignee: Maytag Corporation, Newton, Iowa

[21] Appl. No.: 821,076

[22] Filed: Jan. 16, 1992

[51] Int. Cl.[5] ..... A47L 15/44

[52] U.S. Cl. ..... 134/99.2; 134/113; 222/156; 222/434; 222/454; 222/651

[58] Field of Search ..... 134/93, 99.2, 113; 222/651, 652, , 156, 434, 454

[56] References Cited

U.S. PATENT DOCUMENTS

| | | | |
|---|---|---|---|
| Re. 25,814 | 6/1965 | Buzicky | 222/129 |
| 2,973,769 | 3/1961 | Jacobs | 134/93 X |
| 3,028,051 | 4/1962 | Jacobs | 222/651 X |
| 3,029,826 | 4/1962 | Fink | 134/57 D |
| 3,152,723 | 10/1964 | Perl | 222/23 |
| 3,162,340 | 12/1964 | Erickson | 222/559 |
| 3,262,604 | 7/1966 | Barnard | 222/504 |
| 3,383,917 | 5/1968 | Ryder | 73/327 |
| 3,399,813 | 9/1968 | Theyssen | 222/438 |
| 3,448,618 | 6/1969 | Lomolino | 73/327 |
| 3,535,934 | 10/1970 | Rapata | 73/327 |
| 3,749,288 | 7/1973 | Wade | 222/187 |
| 3,913,793 | 10/1975 | D'Assuncao | 222/454 X |
| 3,980,206 | 9/1976 | Hancock | 222/454 X |
| 4,149,656 | 4/1979 | Nelson | 134/93 X |
| 4,149,657 | 4/1979 | Nelson et al. | 222/651 |
| 4,805,647 | 2/1989 | Marks | 134/93 X |
| 4,820,934 | 4/1989 | Marcade | 134/57 D X |

FOREIGN PATENT DOCUMENTS 1521760 12/1975 United Kingdom .

OTHER PUBLICATIONS

Use & Care Guide; Whirlpool: Undercounter Dishwashers DU8700XX DU8720XX; 1990 Whirlpool Corporation Eltek Type 100288.

*Primary Examiner*—Philip R. Coe

*Attorney, Agent, or Firm*—Zarley, McKee, Thomte, Voorhees, & Sease

[57] ABSTRACT

An adjustable rinse additive dispenser is provided for a dishwasher having a washing compartment and a door pivotal between a horizontal open position and a vertical closed position. The dispenser includes a rinse additive reservoir mounted on the door. A conduit provides a fill opening for adding rinse additive to the reservoir. A knob assembly includes a shaft extending into the conduit so as to substantially seal the opposite ends of the conduit, and defines an annular chamber within the conduit. A trough is provided in the reservoir for holding a fixed quantity of rinse additive. A passageway provides communication between the trough and the annular chamber, and is normally closed by a plunger assembly. During the last rinse cycle of the dishwasher, the plunger assembly is moved to an open position so as to allow rinse additive to flow from the trough into the annular chamber. A leak path is provided in the knob assembly so as to allow a selective amount of rinse additive to flow from the annular chamber into the washing compartment of the dishwasher. The quantity of additive dispensed from the annular chamber can be varied by turning the knob assembly such that the angular position of the leak path is raised or lowered.

19 Claims, 4 Drawing Sheets 8
28
66
62
72
24
76
30
68
64
70
11
50
52
6
54
42
90
98
88
96
78
49B
48
46
94
80
82
84
74
86
36
40
44
26
34
32
38
42

RINSE AID DISPENSER

BACKGROUND OF THE INVENTION

Dishwashers conventionally use a rinse additive, or wetting agent, to enhance the sheeting of water from the dishes, glasses, and other objects being washed The rinse additive aids in drying the objects, and helps to prevent water spots on the objects.

Many factors affect drying and spotting of objects in a dishwasher. For example, drying and spotting of the objects is dependent upon water temperature, the presence of dissolved solids in the rinse water, the type of detergent used during the wash cycle, and the amount of detergent carried over from the wash cycle into the final rinse. The material from which the objects are made also affects drying and spotting. For example, plastic requires a greater quantity of rinse additive than glass or porcelain. Also, the dishwasher tub material, normally plastic or porcelain, has an effect on drying. Since consumers perceive dryness and spotting in different ways, it is desirable to allow the consumer to select the amount of rinse additive to be used.

SUMMARY OF INVENTION

Therefore, a primary objective of the present invention is the provision of an improved rinse additive dispenser for dishwashers.

A further objective of the present invention is the provision of an adjustable rinse additive dispenser for dishwashers.

A further objective of the present invention is the provision of a rinse additive dispenser which can be quickly and easily adjusted by the consumer so as to vary the quantity of additive dispensed.

A further objective of the present invention is the provision of a rinse additive dispenser which can be adjusted without disassembly of the dispenser.

A further objective of the present invention is the provision of a rinse additive dispenser which allows a selective volume of additive to be dispensed so as to accommodate different drying factors.

A further objective of the present invention is the provision of an improved rinse additive dispenser which allows the consumer to quickly and easily ascertain whether additional rinse additive needs to be supplied to the dispenser.

A further objective of the present invention is the provision of a rinse additive dispenser which is economical to manufacture, and durable and efficient in use.

The adjustable rinse additive dispenser of the present invention allows a varying volume of rinse aid or additive to be selectively dispensed into the washing compartment of a dishwasher. The dispenser includes an additive reservoir mounted on the door. A conduit provides communication between the reservoir and the washing compartment, and allows rinse additive to be supplied to the reservoir. The reservoir includes a collection area into which additive flows when the door is moved into a horizontal open position. When the door is pivoted to a vertical closed position, a quantity of additive flows from the collection area and is held in a collection trough.

A shaft having a knob on one end is threadably received within the conduit. A close tolerance between the conduit and the end of the shaft and an O-ring on the opposite end of the shaft substantially seal the opposite ends of the conduit, thereby defining an annular chamber within the conduit. An axially extending slot is provided in the shaft and extends beneath the 0-ring, thereby defining a leak path which bypasses the 0-ring and through which additive will flow from the annular chamber to the washing compartment.

The collection trough includes a passageway providing communication to the annular chamber. A plunger assembly normally closes the passageway so as to prevent flow of additive from the trough to the chamber. The plunger assembly is moved to an open position during the last rinse cycle, such that additive flows from the trough into the annular chamber, and then through the leak path into the washing compartment.

The angular position of the leak path within the annular chamber can be adjusted by turning the knob, and thus the shaft. The conduit is horizontally disposed when the door is in the vertical closed position, such that additive above the leak path flows into the washing compartment, and additive residing below the leak path will not flow into the washing compartment. When the door is moved to the horizontal open position, the remaining additive which did not flow into the washing compartment flows back into the reservoir along the threads of the conduit.

The reservoir includes a well with a raised perimeter edge. When the door is moved to the open position, the well is filled with additive if a sufficient quantity of additive is present in the reservoir to flow over the raised perimeter edge of the well. If an insufficient quantity of additive is present, the well remains dry. A sightglass extends through the knob and shaft so that the consumer can ascertain the presence or absence of additive in the well when the door is opened. When the consumer sees that the well is empty, more additive can be added to the reservoir by removing the knob and shaft from the conduit, and pouring additive through the conduit.

DETAILED DESCRIPTION OF THE PREFERRED EMBODIMENT

Figure 1:
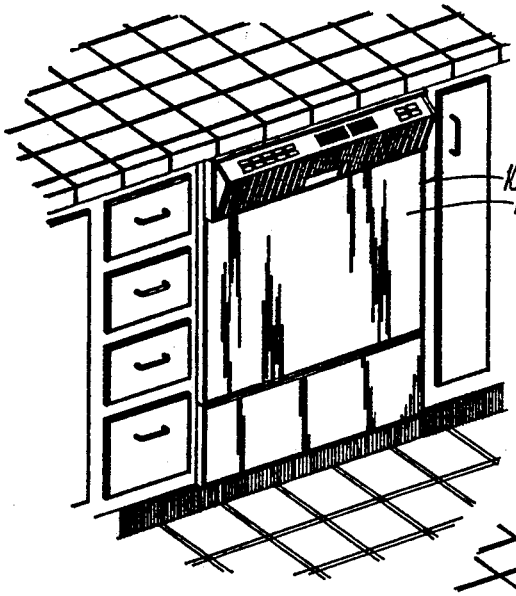
FIG. 1 is a perspective view of a dishwasher mounted beneath a kitchen countertop, with the dishwasher door in a closed position.
Figure 2:
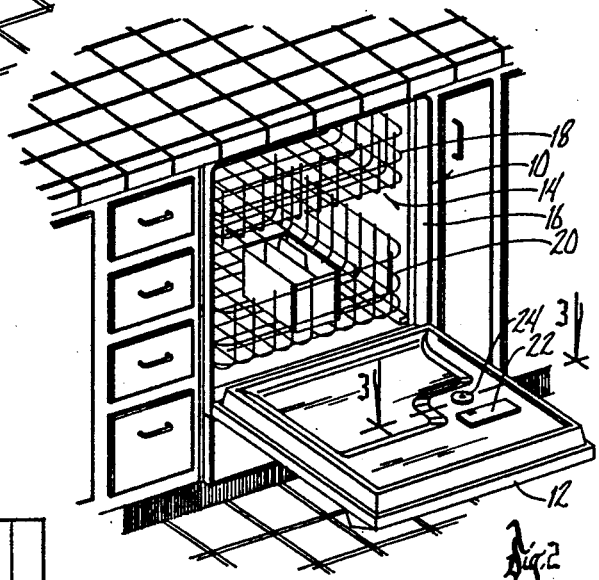
FIG. 2 is a view similar to FIG. 1 showing the door in an open position
Figure 3:
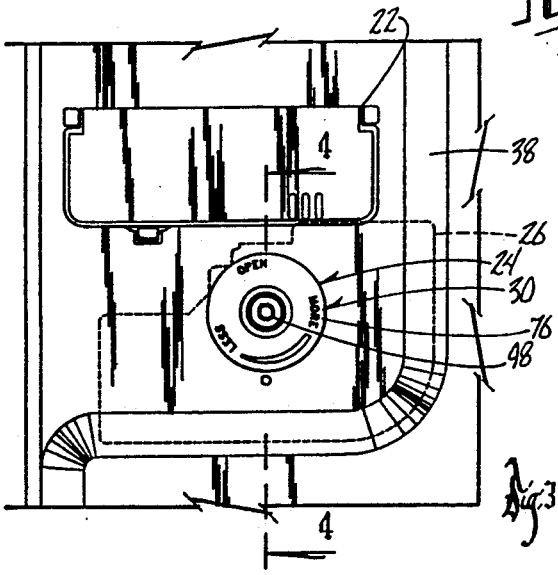
FIG. 3 is an enlarged elevation view taken along lines 3—3 of FIG. 2 showing the rinse additive dispenser of the present invention.

Referring to the drawings, the reference numeral 10 generally designates a dishwasher having a door 12 and a washing compartment 14. Door 12 is pivotal between a substantially vertical closed position, as seen in FIG. 1, and a substantially horizontal open position, as seen in FIG. 2. An access opening 16 allows racks 18, 20 to be moved in and out of the washing compartment 14 when door 12 is opened. Door 12 also includes a detergent dispenser 22.

The present invention is directed towards a rinse additive dispenser 24, which is provided on door 12. The dispenser 24 generally includes a reservoir 26, a plunger assembly 28 and a knob assembly 30.

Figures 4, 5, 6, 7:
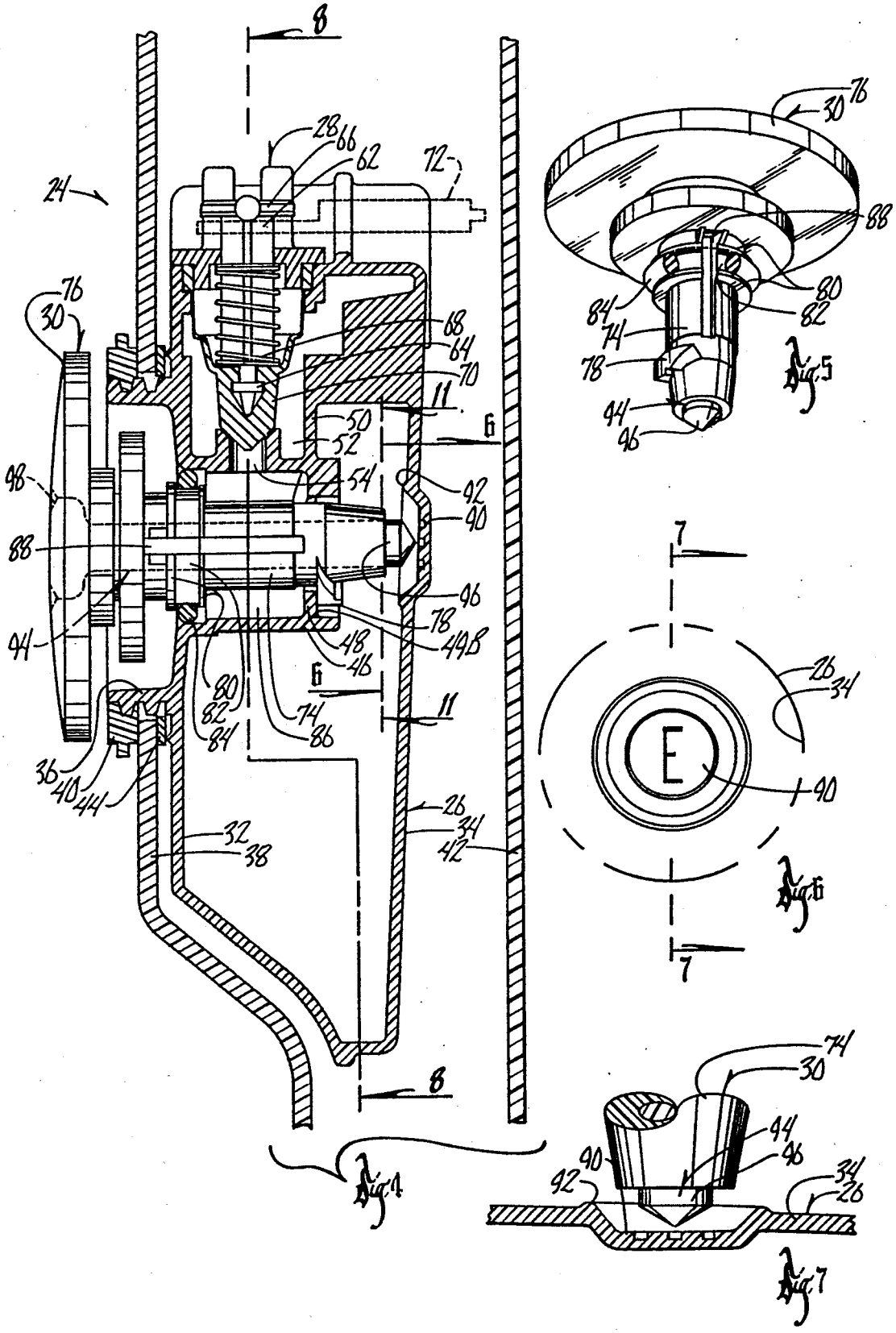
FIG. 4 is an enlarged sectional view taken along lines 4—4 of FIG. 3.
FIG. 5 is a perspective view of the knob assembly of the additive dispenser.
FIG. 6 is a view taken along lines 6—6 of FIG. 4.
FIG. 7 is a view taken along lines 7—7 of FIG. 6 oriented with the door in the open position

More particularly, reservoir 26 includes a front wall 32 and an interconnected back wall 34 A collar 36 extends integrally from front wall 32 and extends through an opening in the inner wall 38 of door 12. Collar 36 includes threads for receiving a nut 40, such that reservoir 26 can be mounted between the inner wall 38 and the outer wall 42 of door 12, as best seen in FIG. 4. A gasket 44 positioned between the inner wall 38 of door 12 and the front wall 32 of reservoir 26 adjacent collar 36 prevents ingress of wash and rinse water into the interior of door 12.

Figure 11:
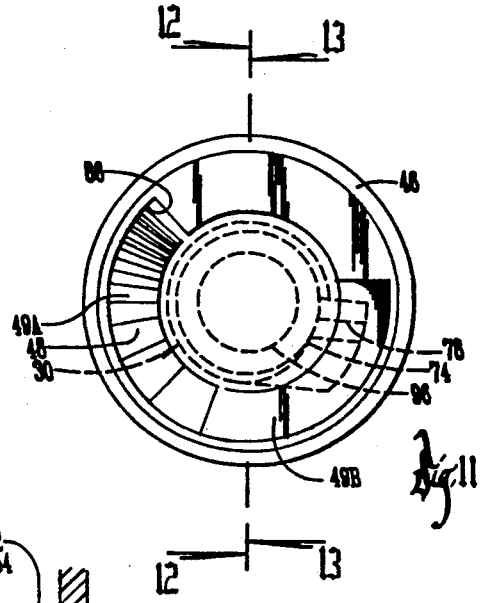
FIG. 11 is a view taken along lines 11—11 of FIG. 4.
Figure 12:
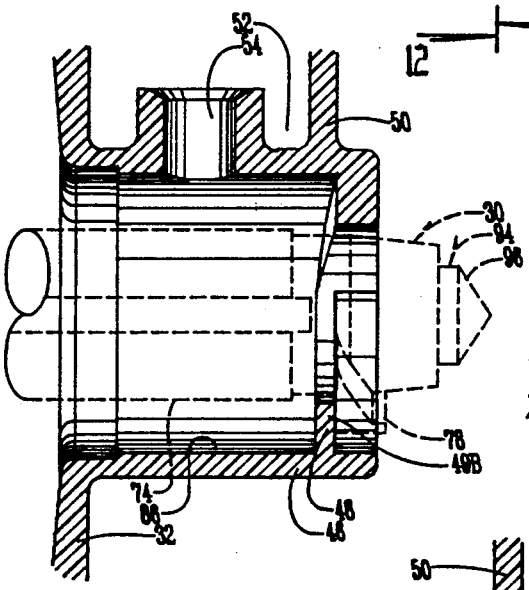
FIG. 12 is a partial sectional view taken along lines 12—12 of FIG. 11.
Figure 13:
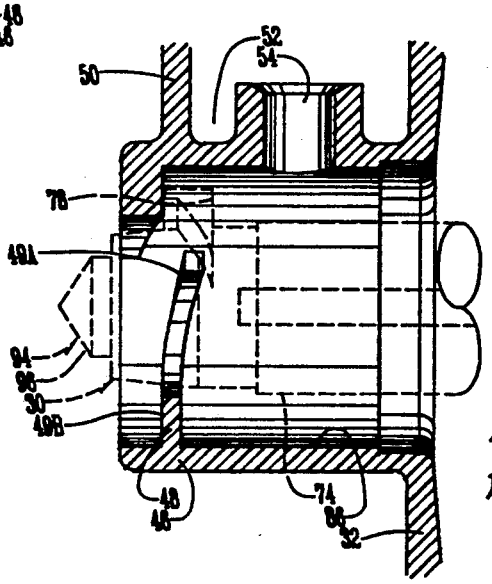
FIG. 13 is a partial sectional view along lines 13—13 of FIG. 11.

Reservoir 26 also includes a cylindrical conduit 46 extending inwardly from the front wall 32 and terminating within the reservoir 26. Conduit 46 is oriented such that its longitudinal axis is substantially horizontally disposed when door 12 is in the vertical closed position Conduit 46 is open at its opposite ends such that a quantity of rinse additive can be poured therethrough when door 12 is open for storage in reservoir 26. Conduit 46 includes a female thread 48 adjacent its internal end, as best seen in FIG. 4. As seen in FIGS. 11–13, thread 48 includes an upper inclined ramp portion 49A and a lower non-inclined portion 49B. Portions 49A and 49B each extend approximately 120°.

Figure 8:
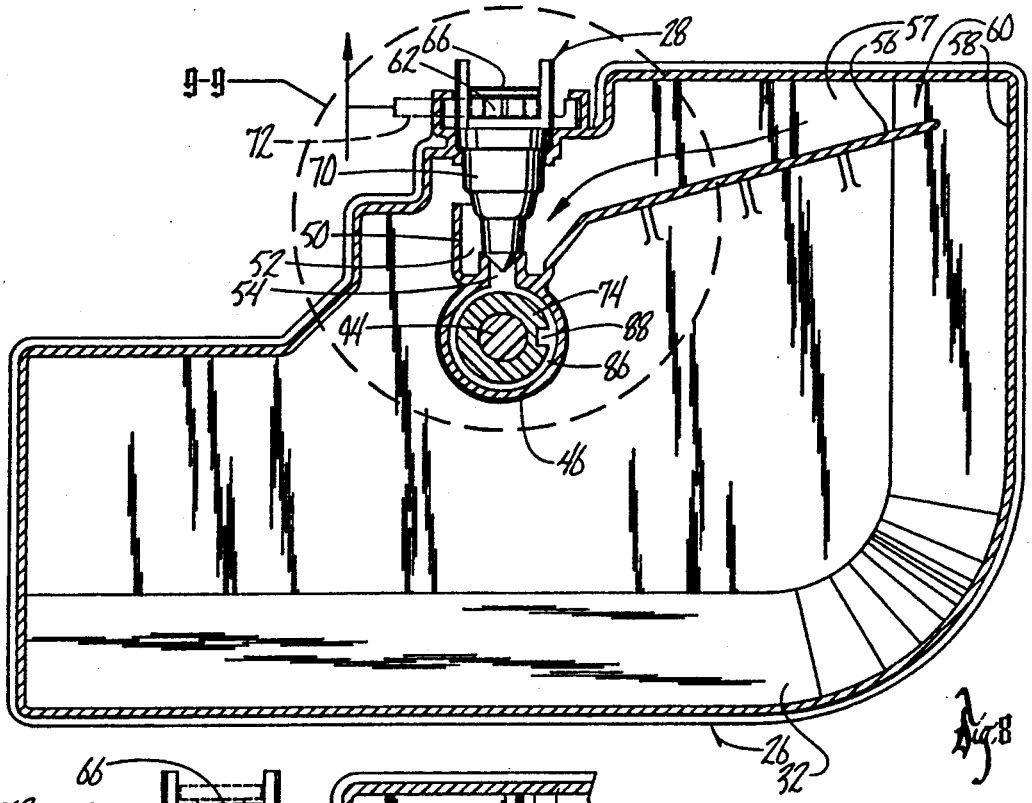
FIG. 8 is a sectional view taken along lines 8—8 of FIG. 4.
Figure 9:
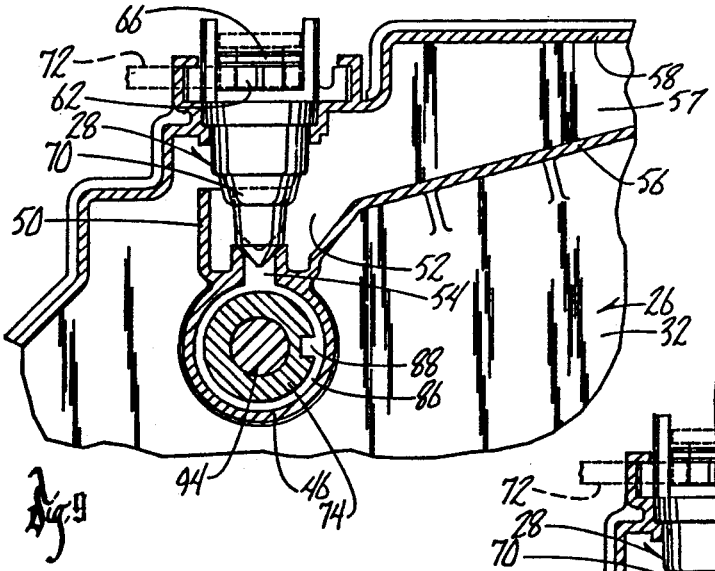
FIG. 9 is an enlarged view taken along lines 9—9 of FIG. 8, with the leak path of the knob assembly shown at a 3 o'clock position
Figure 10:
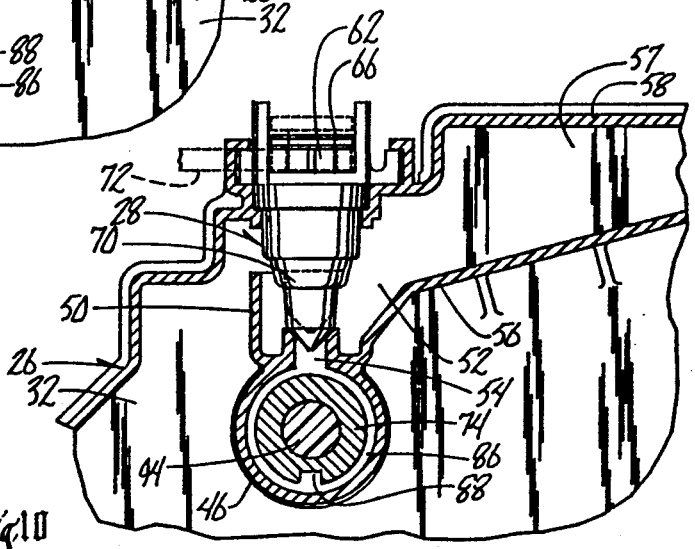
FIG. 10 is a view similar to FIG. 9 showing the leak path of the knob assembly at a 6 o'clock position.

Reservoir 26 has an internal wall 50, as best seen in FIGS. 8–10, extending from conduit 46. Internal wall 50 defines a holding or collection trough 52 adjacent conduit 46. A passageway 54 provides communication between collection trough 52 and conduit 46 Internal wall 50 has an extension 56 extending toward the perimeter sidewall 58 of reservoir 26. Extension 56 terminates at a spaced distance from sidewall 58 so as to define an inlet 60 leading to collection trough 52 As seen in FIG. 4, the back wall 34 of reservoir 26 is not parallel with the front wall 32 thereof Thus, when door 12 is in the horizontal open position, as seen in FIG. 2, the rinse additive within reservoir 26 flows toward inlet 60 so as to fill a collecting area 57 bounded by extension 56, perimeter sidewall 58 and back wall 34. When door 12 is moved to the vertical closed position, rinse additive flows from collecting area 57 to the trough 52 by way of extension 56. Excess additive flows over the edge of trough 52, such that a fixed quantity of additive is present in the trough for each operation of dishwasher 10.

The plunger assembly 28 includes a plunger rod 62 with a head 64 at one end and a tail 66 at the opposite end Plunger rod 62 extends through an opening in the perimeter sidewall 58 of reservoir 26 and into collection trough 52. A spring 68 normally biases plunger rod 62 toward the passageway 54 in collection trough 52 A flexible membrane encloses head 64 and spring 68 of the plunger assembly 28 and provides a seal at the opening in the sidewall 58 of the reservoir 26. An actuator lever 72 is operatively connected to a wax motor (not shown) so as to retract plunger rod 62, at a predetermined time in the washing operation, from a normally extended or closed position, wherein membrane 70 engages passageway 54 of collection trough 52, to a retracted or open position wherein membrane 70 is disengaged from the passageway 54 When plunger rod 62 is in the closed position, fluid communication between collection trough 52 and conduit 46 is prevented. When plunger rod 62 is in the retracted open position, passageway 54 provides fluid communication between collection trough 52 and conduit 46.

Knob assembly 30 includes a hollow shaft 74 and an adjustment knob 76 on one end of shaft 74. The opposite end of shaft 74 includes a male thread portion 78 adapted to threadably mate with the female thread 48 of conduit 46. A pair of flanges 80 are provided on shaft 74 so as to define a groove 82 in which an O-ring seal 84 is mounted. O-ring 84 provides a seal between shaft 74 and the outer end of conduit 46 adjacent to front wall 32 of reservoir 26, as best seen in FIG. 4. A close tolerance between shaft 74 and the inner diameter of female threads 48 on conduit 46 substantially seals the inner end of the conduit from the remaining portion of reservoir 26 when door 12 is in the vertical closed position. However, when door 12 is moved to the horizontal open position, additive remaining within conduit 46 can flow along thread 48 for return to reservoir 26. Thus, shaft 74 and conduit 46 define an annular chamber 86 when the shaft is positioned within the conduit. Shaft 74 extends outwardly from conduit 46 such that adjustment knob 76 is easily accessible adjacent to the inner wall 38 of door 12.

Shaft 74 includes an elongated slot 88 which cuts through flanges 80 and groove 82 so as to extend beneath O-ring 84. Slot 88 defines a leak path for additive to flow from the annular chamber 86 to the washing compartment 14. By turning knob 76, the angular position of slot 88 within the annular chamber 86 can be varied from a 12 o'clock position to a 6 o'clock position. The angular position of slot 88 determines the quantity of additive which will flow from chamber 86 to washing compartment 14. Since slot 88 defines the only leak path through which additive can flow from annular chamber 86 when the door 12 is in the vertical closed position, only the additive at or above the level of the leak path will flow outwardly into the washing compartment. Preferably, 1.0–2.0 cubic centimeters of additive are dispensed at the beginning of the final rinse cycle. Additive remaining below the leak path will be retained in the annular chamber 86, until the door is moved to the horizontal open position, at which time the remaining additive will flow downwardly along thread 48 of conduit 46 and into reservoir 26. A small insignificant amount of additive may pass between shaft 74 and threads 48 of conduit 46, despite the close tolerance, when door 12 is closed.

Back wall 34 of reservoir 26 has a well 90 formed therein. Well 90 has a perimeter edge 92 which is raised slightly above back wall 34 of reservoir 26. A letter "E" is printed at the bottom of well 90, as best seen in FIG. 6.

A sightglass 94 extends through a central opening in knob 76 and through hollow shaft 74. Sightglass 94 has a pointed end 96 extending beyond the end of shaft 74 so as to be in close proximity to well 90 when knob assembly 30 is positioned within conduit 46. Sightglass 94 has an opposite end 98 which is exposed on the face of knob 76 so as to be visible when door 12 is in the open position When the door is open and rinse additive resides in well 90, the consumer can look through sightglass 94 and the sightglass will appear dark. Such visual presence of the rinse additive indicates that there is a sufficient quantity of rinse additive for the next washing operation. When door 12 is open and rinse additive is not present in well 90, sightglass 94 will appear bright, thus indicating that rinse additive needs to be added to reservoir 26.

In operation, a first quantity of rinse additive is poured into reservoir 26 through conduit 46 when door 12 is open and knob assembly 30 is removed from the conduit. This first quantity of additive is normally enough for many washing operations. Knob assembly 30 is then threaded into conduit 46 so as to substantially seal the opposite ends of the conduit. The rinse additive will flow to the lowest point in reservoir 26, that is, collection area 57, when door 12 is open. When door 12 is closed, a second quantity of rinse additive will flow from collection area 57 along extension 56 into collection trough 52, and the excess rinse additive will flow over the edge of the collection trough 52, such that a fixed quantity of rinse additive is present in trough 52 for each washing operation. This second quantity of rinse additive retained in collection trough 52 is less than the first quantity of additive initially poured into reservoir 26.

With door 12 closed, dishwasher 10 is actuated to commence the washing operation. During the fill of the last rinse cycle, actuator lever 72 moves plunger assembly 28 from its normally closed position wherein communication between collection trough 52 and annular chamber 86 is prevented, to an open position wherein rinse additive is free to flow from trough 52 through passageway 54 and into annular chamber 86. In FIGS. 9 and 10, the normal closed position of plunger assembly 28 is shown in solid lines, and the open position of the plunger assembly is shown in broken lines.

As the rinse additive fills annular chamber 86 and reaches the level of leak path slot 88, the additive will flow through the leak path and under O-ring 84 so as to be dispensed into washing compartment 14. The quantity of rinse additive dispensed from chamber 86 is dependent upon the angular position of the leak path slot 88. For example, when the leak path is at a 3 o'clock position, as shown in FIG. 9, approximately one half of the additive in chamber 86 is dispensed into the washing compartment 14. When the leak path is at a 6 o'clock position, as shown in FIG. 10, substantially all of the additive in chamber 86 flows into the washing compartment 14. The relative angular position of the leak path is adjusted by manually turning knob 76 when door 12 is open. As male thread 78 moves along inclined portion 49A of female thread 48, knob assembly 30 is pulled inwardly within conduit 46, such that end 96 of sightglass 94 is positioned within well 90. When thread 78 is at the upper most end of inclined portion 49A, the leak path is approximately at a 12 o'clock position. When thread 78 is at the lower most end of inclined portion 49A, the leak path is approximately at a 3 o'clock position. As knob 76 is turned further, thread 78 engages flat or non-inclined portion 49B, end 96 of sightglass 94 remains a fixed spaced distance from well 90, while the leak path moves from a 3 o'clock to a 6 o'clock position. As the leak path is turned from a 12 o'clock position to a 6 o'clock position, increased amounts of rinse additive will be dispensed into washing compartment 14. Similarly, as the leak path is moved from a 6 o'clock position to a 12 o'clock position, decreased amounts of rinse additive will be dispensed into the washing compartment.

Thus, the consumer can selectively adjust the quantity of rinse additive to be dispensed during the last rinse cycle so as to enhance drying of the objects in dishwasher 10, depending upon factors such as water temperature, dissolved solids in the water, type of detergent, and type of objects being washed.

In the drawings and Specification, there has been set forth a preferred embodiment of the invention, and although specific terms are employed, these are used in a generic and descriptive sense only and not for purposes of limitation. Changes in the form and proportion of parts, as well as in the substitution of equivalents, are contemplated as circumstances may suggest or render expedient without departing from the spirit or scope of the invention as further defined in the following claims.

We claim:

1. An adjustable rinse additive dispenser for a dishwasher having a washing compartment and a door to provide access to the washing compartment, the door being pivotal between a horizontal open position and a vertical closed position, the dispenser comprising:

an additive reservoir mounted on the door;

a chamber formed in the reservoir for receiving rinse additive from the reservoir and having an opening communicating with the washing compartment;

release means for releasing rinse additive from the reservoir to the chamber;

a knob assembly adjustably mounted in the reservoir and having a first end extending into the chamber and a second end extending exteriorly of the door; and a leak path in the knob assembly providing communication between the chamber and the washing compartment, the leak path being selectively positioned by turning the knob assembly such that a varying amount of rinse additive can be dispensed from the chamber into the washing compartment.

2. The additive dispenser of claim 1 wherein the knob assembly is threadably mounted in the reservoir.

3. The additive dispenser of claim 1 wherein the knob assembly includes seal means to seal the chamber against leakage of additive into the washing compartment, and wherein the leak path by-passes the seal means.

4. The additive dispenser of claim 1 wherein the knob assembly includes a shaft having a longitudinal axis, the leak path being an elongated slot extending axially along the shaft.

5. The additive dispenser of claim 4 wherein the leak path is movable between a 12 o'clock position and a 6 o'clock position.

6. The additive dispenser of claim 1 wherein the release means includes a plunger assembly movable between an open position providing fluid communication between the reservoir and the chamber, and a closed position preventing fluid communication between the reservoir and the chamber, and actuation means for moving the plunger assembly from the closed position to the open position.

7. The additive dispenser of claim 6 wherein the reservoir includes a collection trough into which rinse additive flows when the door is in the open position and in which a quantity of additive is stored when the door is in the closed position.

8. The additive dispenser of claim 7 wherein the trough includes a passageway to the chamber, with the plunger assembly normally closing the passageway, and with the quantity of additive passing from the collection trough into the chamber when the plunger moves to the open position.

9. The additive dispenser of claim 1 wherein the reservoir includes a well with a raised perimeter edge, such that additive is collected in the well when a sufficient amount of additive is present in the reservoir to flow over the perimeter edge of the well when the door is in the open position.

10. The additive dispenser of claim 9 wherein the knob assembly includes a sightglass for sighting the presence or absence of additive in the well when the door is in the open position.

11. The additive dispenser of claim 1 wherein the chamber includes opposite open ends, the knob assembly normally substantially closing the opposite ends and being removable from the reservoir such that additive can be added to the reservoir through the open ends of the chamber.

12. The additive dispenser of claim 1 wherein the chamber and knob assembly include mating threads for adjustably mounting the knob assembly in the chamber.

13. The additive dispenser of claim 12 wherein one of the threads has a non-inclined portion such that the knob assembly can move radially with respect to the chamber without moving linearly relative to the chamber.

14. A variable dosage additive dispenser for a dishwasher having a washing compartment, an access opening and a door for closing the access opening, comprising:

container means mounted to the access door for storing additive, and including a conduit communicating between the container means and the washing compartment;

additive holding means in the container means for receiving additive when the door is open and for holding a predetermined quantity of additive when the door is closed, the holding means having a passageway to the conduit;

stop means associated with the holding means and operable for selectively opening and closing the passageway to control the flow of additive from the holding means into the conduit; and dosage varying means including a shaft portion coaxially received in the conduit, seal means between the shaft portion and the conduit to prevent the ingress of washing fluid into the conduit and means defining a leak path between the seal means and the shaft portion, the dosage varying means further including a knob associated with the shaft portion for manually operating the shaft portion to selectively angularly position the leak path along the circumference of the conduit for varying the quantity of additive dispensed into the washing compartment.

15. The additive dispenser of claim 14 wherein the knob is connected to the shaft portion and the shaft portion is threadably mounted within the conduit.

16. The additive dispenser of claim 14 wherein the leak path is a slot extending axially along the shaft portion.

17. The additive dispenser of claim 14 wherein the stop means includes a plunger normally closing the passageway and being movable to open the passageway.

18. The additive dispenser of claim 14 wherein the container means includes a well with a raised perimeter edge, whereby additive collects in the well when a sufficient quantity of additive is present in the container means so as to flow over the perimeter edge when the door is open.

19. The additive dispenser of claim 18 further comprising a sightglass extending through the knob and shaft portion so as to provide a visual observation of the presence or absence of additive in the well then the door is open.

* * * * *